US009505105B2

(12) United States Patent
Chang

(10) Patent No.: US 9,505,105 B2
(45) Date of Patent: Nov. 29, 2016

(54) ROTATABLE HANDLE FOR WRENCH

(71) Applicant: Chih-Min Chang, Changhua County (TW)

(72) Inventor: Chih-Min Chang, Changhua County (TW)

( * ) Notice: Subject to any disclaimer, the term of this patent is extended or adjusted under 35 U.S.C. 154(b) by 322 days.

(21) Appl. No.: 14/332,186

(22) Filed: Jul. 15, 2014

(65) Prior Publication Data

US 2016/0016294 A1 Jan. 21, 2016

(51) Int. Cl.

| | |
|---|---|
| ***B25G 1/06*** | (2006.01) |
| ***B25B 13/06*** | (2006.01) |
| ***B25B 13/46*** | (2006.01) |
| ***B25B 13/48*** | (2006.01) |

(52) U.S. Cl.

CPC ..... *B25B 13/48* (2013.01); *B25G 1/066* (2013.01)

(58) Field of Classification Search

CPC ..... B25B 13/48; B25B 13/461; B25B 13/46; B25G 1/066; B25G 1/06

See application file for complete search history.

(56) References Cited

U.S. PATENT DOCUMENTS

| | | | | |
|---|---|---|---|---|
| 5,694,818 | A * | 12/1997 | Nickipuck | B25B 13/461 403/97 |
| 6,883,404 | B2 * | 4/2005 | Hsien | B25B 13/04 81/125.1 |
| 7,080,581 | B2 * | 7/2006 | Reese | B25B 13/06 81/124.2 |
| 7,204,175 | B2 * | 4/2007 | Hsieh | B25B 23/0035 81/177.2 |
| 7,497,149 | B2 * | 3/2009 | Lin | B25B 13/461 403/109.3 |
| 9,199,363 | B2 * | 12/2015 | Chen | B25B 23/0007 81/119 |

* cited by examiner

*Primary Examiner* — David B Thomas

(74) *Attorney, Agent, or Firm* — Muncy, Geissler, Olds & Lowe, P.C.

(57) ABSTRACT

A rotatable handle for a wrench includes a fixation rod, a first handle body, and a second handle body. An end of the first handle body is rotatably and axially movably sleeved onto to an end of the fixation rod, and the other end of the first handle body is adapted for being fixed with a wrench head. An end of the second handle body is rotatably and axially movably sleeved onto the other end of the fixation rod, and the other end of the second handle body is adapted for being fixed with another wrench head. Therefore, the relative angle between the two wrench heads can be adjusted appropriately by the relative rotation of the first handle body and the second handle body.

6 Claims, 7 Drawing Sheets

ROTATABLE HANDLE FOR WRENCH

BACKGROUND OF THE INVENTION

1. Field of the Invention

The present disclosure relates to a wrench, and more particularly to a rotatable handle for the wrench.

2. Description of the Related Art

A common wrench has wrench heads disposed at two ends of a handle thereof respectively, and one of the wrench heads can be used to screw or loose the bolt, the screw nut or the like by a force applied on the handle. However, the handle of the common wrench usually has a fixed structure. While the wrench is operated in a narrow space or an environment with blocks of structural objects, the user must change his/her gripping angle frequently so as to exactly sleeve the wrench head onto the associated workpiece. Such operation approach is easy to bother the user.

SUMMARY OF THE INVENTION

One of objectives of the present disclosure is to provide a rotatable handle for a wrench, which enables adjustment of the operation angle of a wrench head that is cooperated with the rotatable handle.

In order to achieve the objective, the rotatable handle of the present disclosure comprises a fixation rod, a first handle body, and a second handle body. The first handle body has a first inner end surface, at least two positioning holes recessed inwardly from the first inner end surface, a first outer end surface opposite to the first inner end surface, and a first mounting slot located between the first inner end surface and the first outer end surface. The first handle body is rotatably and axially movably sleeved onto an end of the fixation rod via the first mounting slot. The second handle body has a second inner end surface, a positioning pillar protruding outwardly from the second inner end surface, a second outer end surface opposite to the second inner end surface, and a second mounting slot located between the second inner end surface and the second outer end surface. The second handle body is rotatably and axially movably sleeved onto the other end of the fixation rod in such a way that the positioning pillar is inserted into one of the positioning holes of the first handle body. The first handle body and the second handle body can rotate relative to each other and be positioned by engagement between the positioning holes of the first handle body and the positioning pillar of the second handle body after the first handle body and the second handle body are rotated to an appropriate angle.

In an embodiment of the present disclosure, a restoring spring is disposed inside the first mounting slot of the first handle body for providing a restoring force to the first handle body for maintaining the engagement of the positioning pillar of the second handle body with one of the positioning holes of the first handle body.

In an embodiment of the present disclosure, the first handle body further has a first rectangular fixation slot in communication with the first mounting slot. A first rectangular fixation block is disposed inside the first rectangular fixation slot for fixing a wrench head. The second handle body further has a second rectangular fixation slot in communication with the second mounting slot. A second rectangular fixation block is disposed inside the second rectangular fixation slot for fixing another wrench head.

DETAILED DESCRIPTION OF THE PREFERRED EMBODIMENTS

Figure 1:
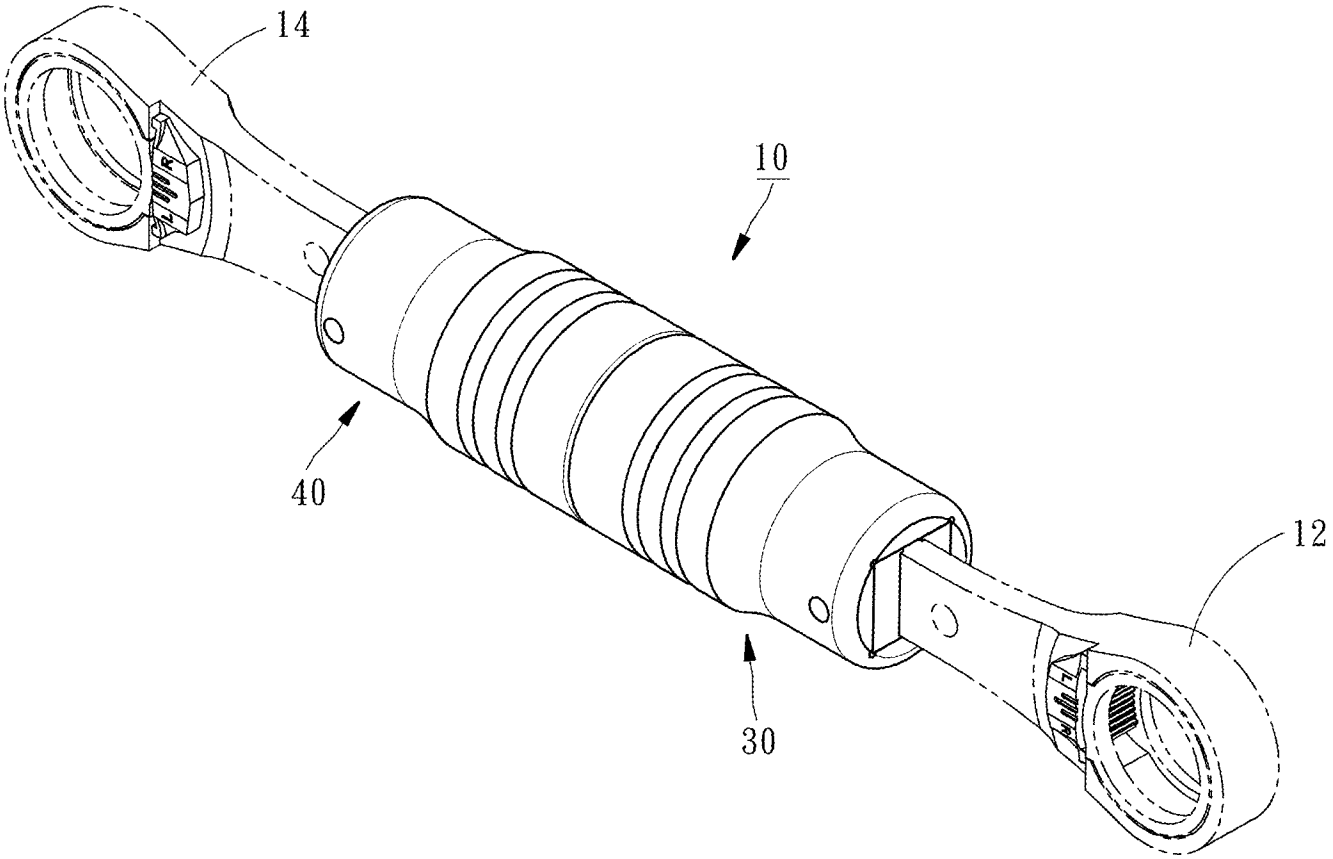
FIG. 1 is a schematic perspective view of a rotatable handle of the present disclosure in cooperation with wrench heads.

Reference will now be made in detail to the exemplary embodiments of the present disclosure, examples of which are illustrated in the accompanying drawings. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. These embodiments are provided so that this disclosure will be thorough and complete, and will fully convey the inventive concept to those skilled in the art. The relative proportions and ratios of elements in the drawings may be exaggerated or diminished in size for the sake of clarity and convenience in the drawings, and such arbitrary proportions are only illustrative and not limiting in any way. The same reference numbers are used in the drawings and the description to refer to the same or like parts.

It will be understood that, although the terms 'first', 'second', 'third', etc., may be used herein to describe various elements, these elements should not be limited by these terms. The terms are used only for the purpose of distinguishing one component from another component. Thus, a first element discussed below could be termed a second element without departing from the teachings of embodiments. As used herein, the term "or" includes any and all combinations of one or more of the associated listed items.

Figure 2:
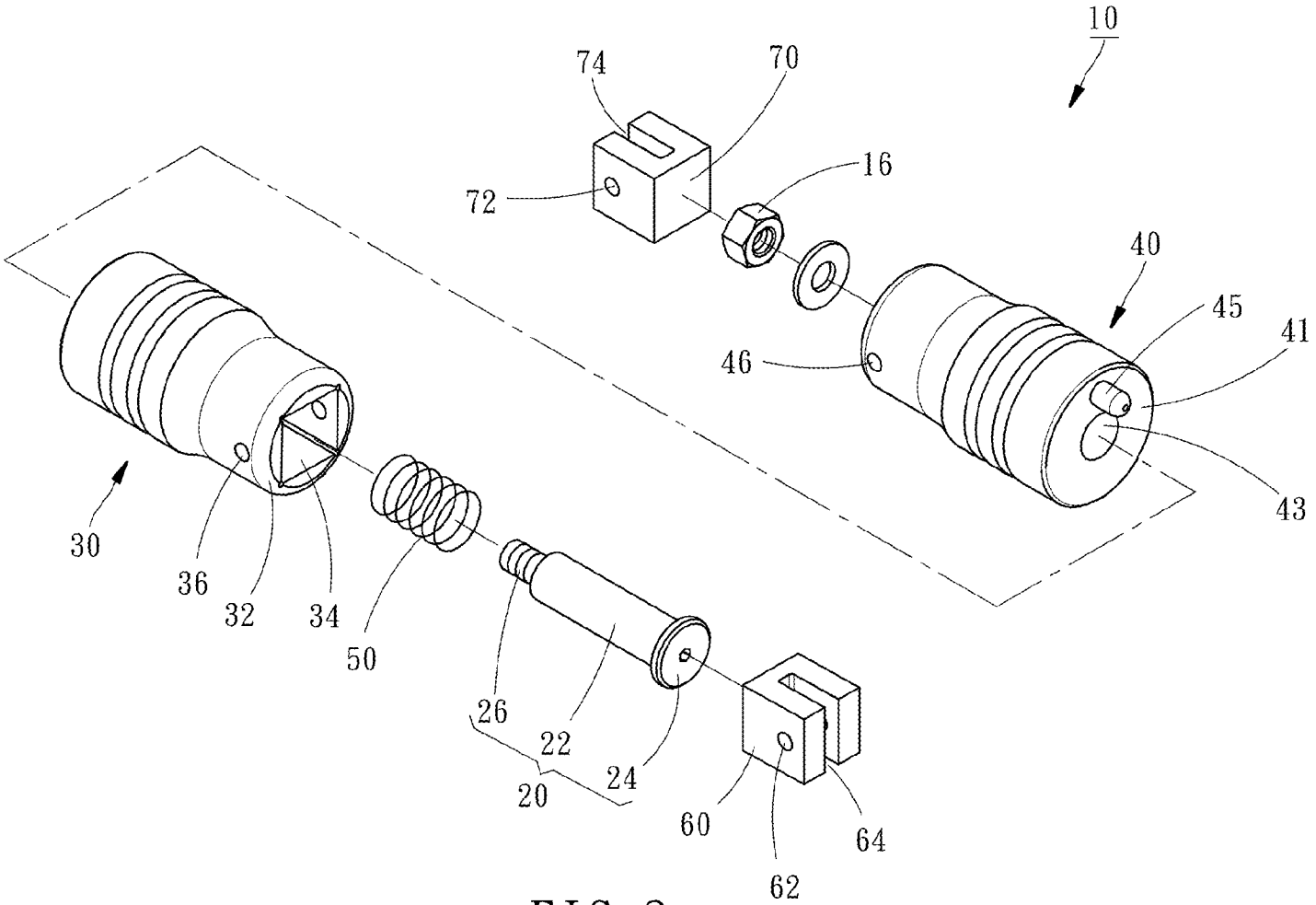
FIG. 2 is an exploded view of the present disclosure.

Referring to FIG. 1 and FIG. 2, the rotatable handle 10 of the present disclosure comprises a fixation rod 20, a first handle body 30, and a second handle body 40.

The fixation rod 20 has a rod body 22. An end of the rod body 22 is connected with a rod head 24, and the other end of the rod body 22 is integrally connected with a threaded tail 26.

Figure 3:
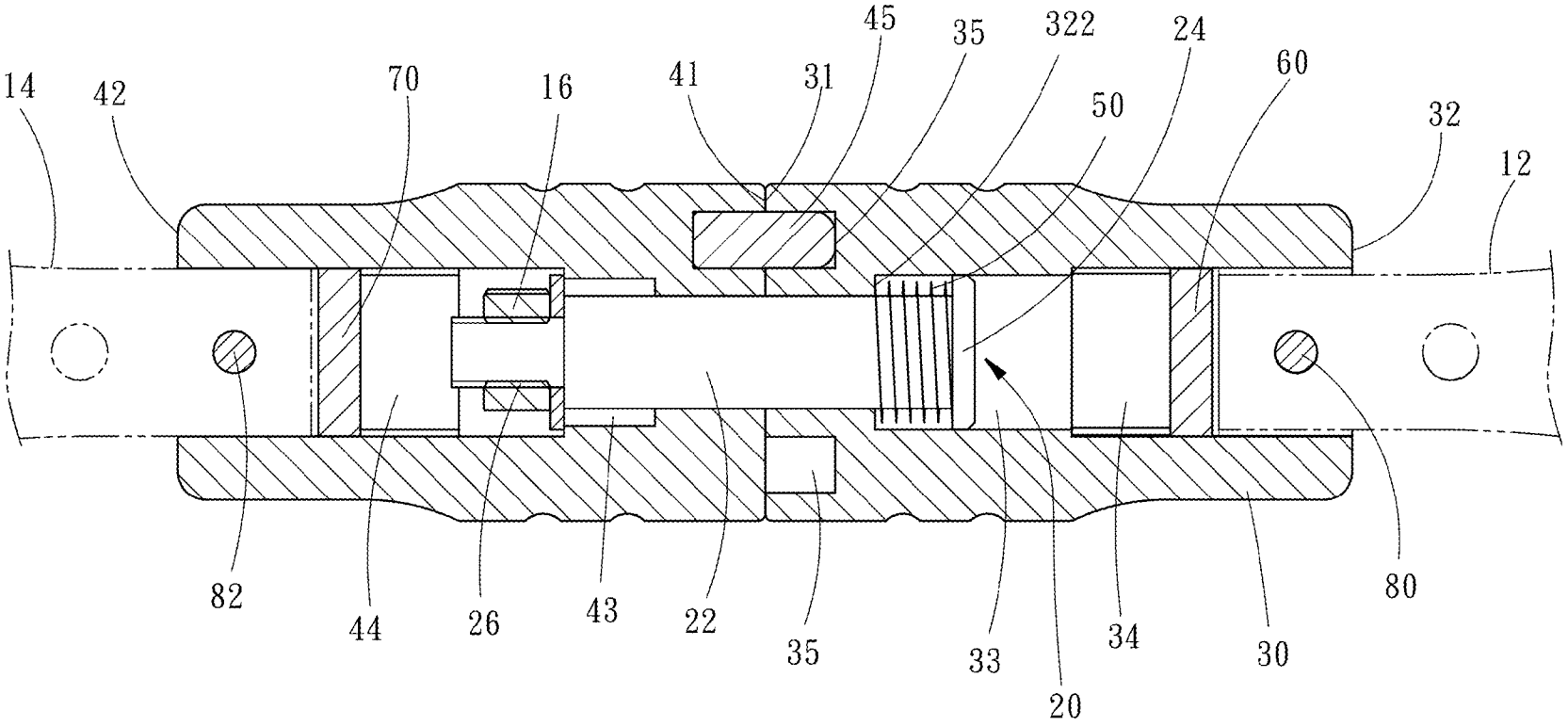
FIG. 3 is a longitudinal section view of the present disclosure.
Figure 5:
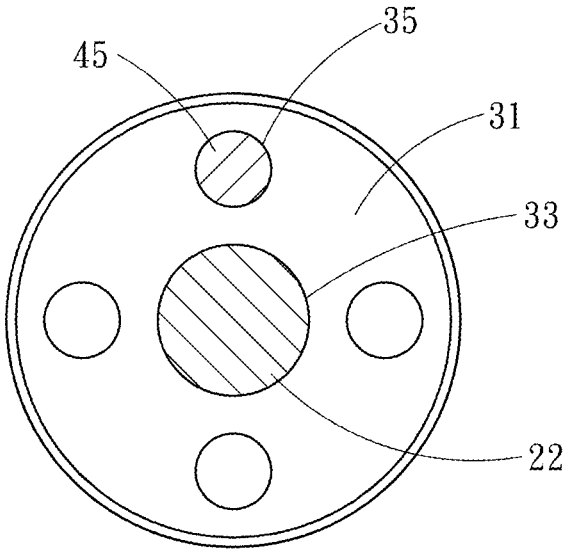
FIG. 5 is a transverse section view of the present disclosure, showing that the positioning pillar of the second handle body is inserted into one of the positioning holes of the first handle body.

As shown in FIG. 2 and FIG. 3, the first handle body 30 has a first inner end surface 31, a first outer end surface 32 opposite to the first inner end surface 31, a first mounting slot 33 between the first inner end surface 31 and the first outer end surface 32, and a first rectangular fixation slot 34 between the first inner end surface 31 and the first outer end surface 32. The first mounting slot 33 extends like steps from the first inner end surface 31 toward the first outer end surface 32 to form a stop surface 332, as shown in FIG. 3, and the first rectangular fixation slot 34 extends from the first outer end surface 32 toward the first inner end surface 31 and is communicated with the first mounting slot 33. In addition, as shown in FIG. 3 and FIG. 5, the first handle body 30 further has four positioning holes 35 which are recessed inwardly from the first inner end surface 31 and arranged around the first mounting slot 33 equiangularly.

The second handle body 40 has a second inner end surface 41, a second outer end surface 42 opposite to the second inner end surface 41, a second mounting slot 43 between the second inner end surface 41 and the second outer end surface 42, and a second rectangular fixation slot 44 between the second inner end surface 41 and the second outer end surface 42. The second mounting slot 43 extends like steps from the second inner end surface 41 toward the second outer end surface 42. The second rectangular fixation slot 44 extends from the second outer end surface 42 toward the second inner end surface 41 and is communicated with the second mounting slot 43. In addition, the second handle body 40 has a positioning pillar 45 protruding outwardly from the second inner end surface 41 for inserting into one of the positioning holes 35 of the first handle body 30. It is to be understood that the second handle body 40 may be configured having a plurality of protruding pillars 45 corresponding in number to the positioning holes 35 of the first handle body 30, such that the positioning pillars 45 are respectively inserted into the positioning holes 35 one by one.

In assembling, the fixation rod 20 is inserted into the second mounting slot 43 of the second handle body 40 via the first mounting slot 33 of the first handle body 30, and then a nut 16 is screwingly engaged with the threaded tail 26 of the fixation rod 20 so as to complete the assembly of these three members. After the assembly is completed, when the positioning pillar 45 of the second handle body 40 is inserted into one of the positioning holes 35 of the first handle body 30, the first handle body 30 and the second handle body 40 cannot rotate relative to the fixation rod 20, and when the positioning pillar 45 of the second handle body 40 departs from the positioning holes 35 of the first handle body 30, the first handle body 30 and the second handle body 40 can rotate relative to the fixation rod 20, respectively. In addition, in order to positively maintain engagement of the positioning pillar 45 of the second handle body 40 into one of the positioning holes 35 of the first handle body 30, a restoring spring 50 is sleeved onto the rod body 22 of the fixation rod 20 and abuts between the rod head 24 of the fixation rod 20 and the stop surface 332 of the first handle body 30 for providing a restoring force to the first handle body 30.

On the other hand, the present disclosure further comprises a first rectangular fixation block 60 and a second rectangular fixation block 70. The first rectangular fixation block 60 is plugged into the first rectangular fixation slot 34 of the first handle body 30 and fixed by a first bolt 80. The first bolt 80 is inserted into a first radial hole 36 of the first handle body 30 and a third radial hole 62 of the first rectangular fixation block 60. The second rectangular fixation block 70 is plugged into the second rectangular fixation slot 44 of the second handle body 40 and fixed by a second bolt 82. The second bolt 82 is inserted into a second radial hole 46 of the second handle body 40 and a fourth radial hole 72 of the second rectangular fixation block 70. In addition, the first rectangular fixation block 60 has a first insert slot 64 for fixing a wrench head 12. The second rectangular fixation block 70 has a second insert slot 74 for fixing another wrench head 14.

Figure 4:
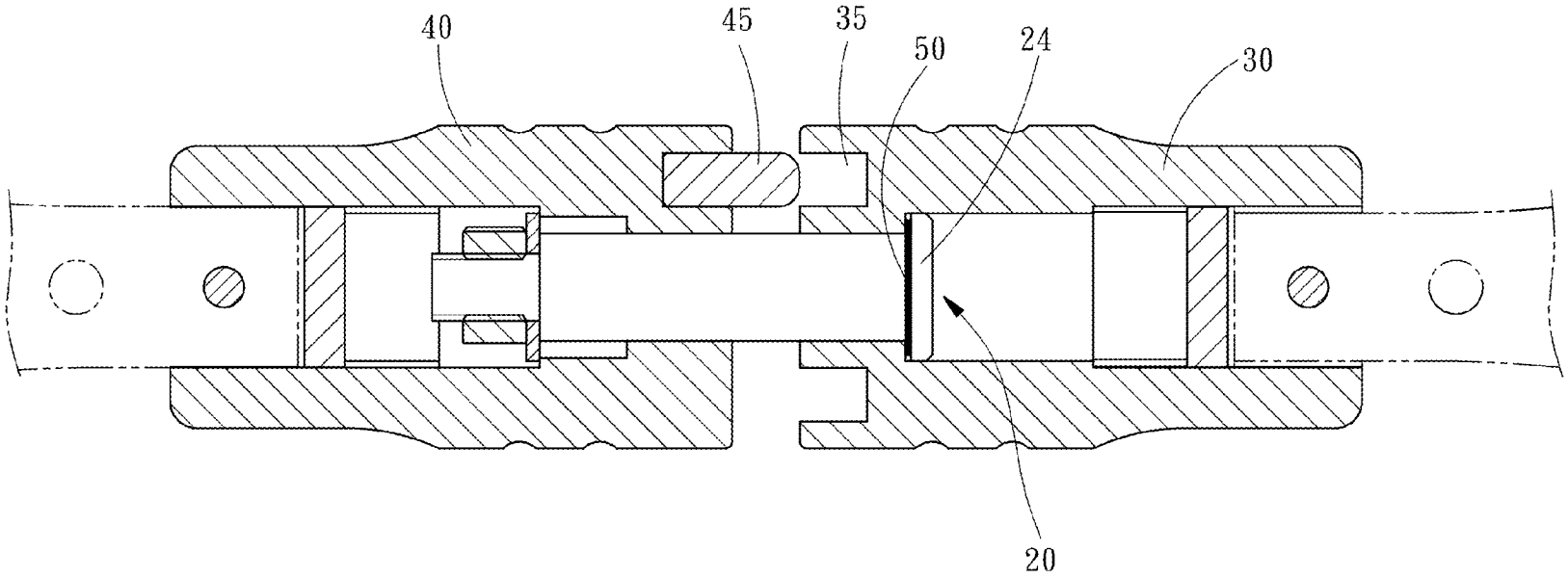
FIG. 4 is similar to the FIG. 3, but showing that the positioning holes of the first handle body and the positioning pillar of the second handle body are separated from one another.
Figure 6:
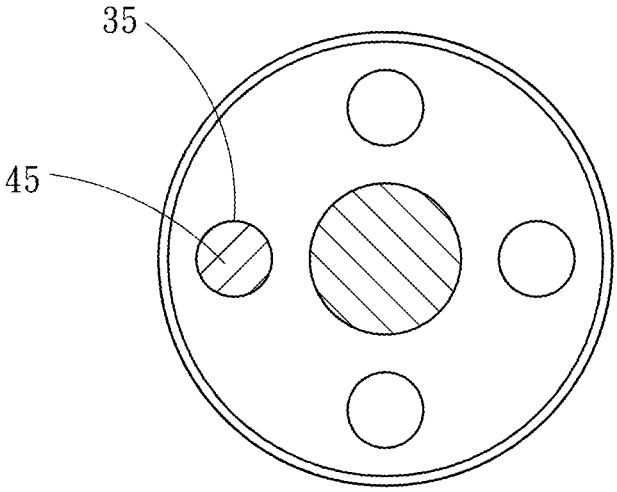
FIG. 6 is similar to the FIG. 5, but showing that the positioning pillar of the second handle body is inserted into another positioning hole of the first handle body.
Figure 7:
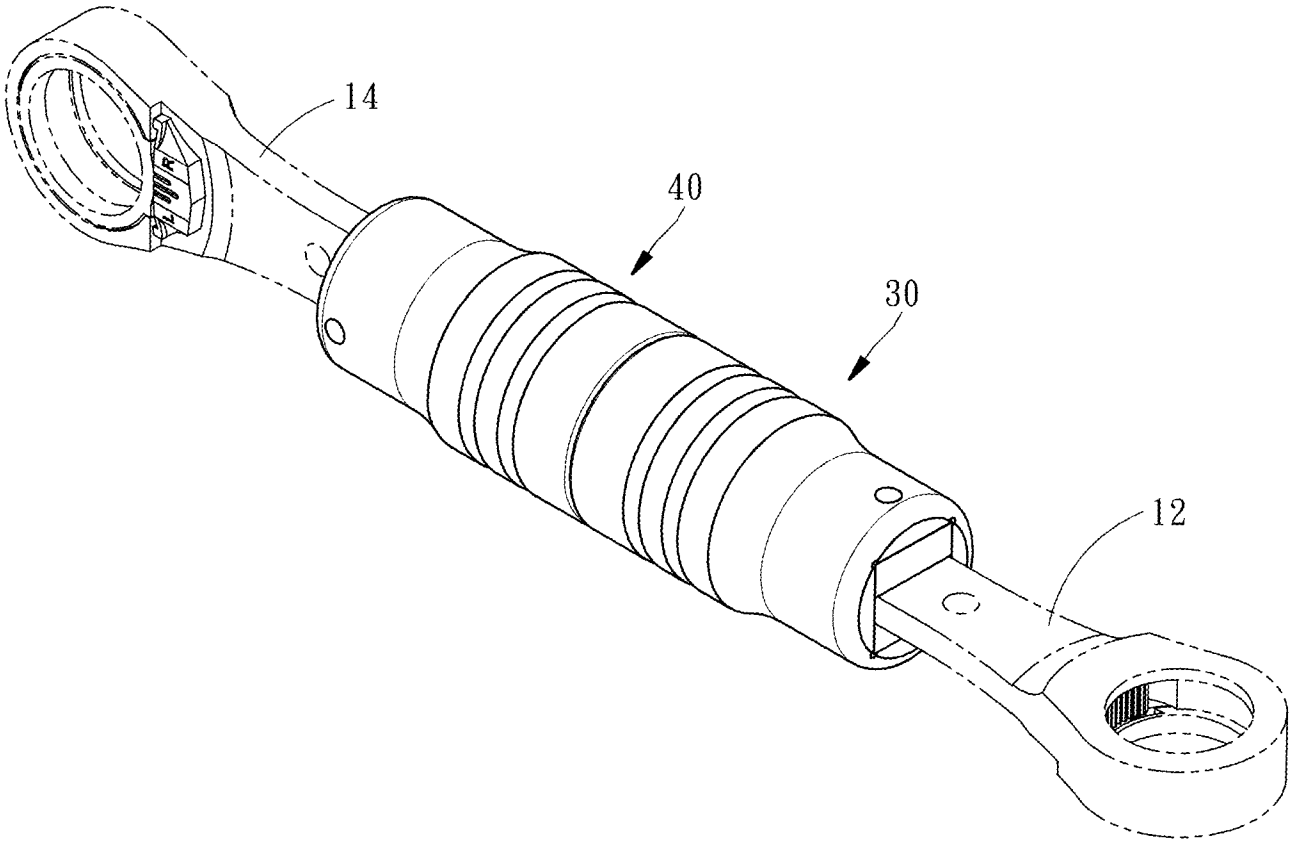
FIG. 7 is another schematic perspective view of the rotatable handle of the present disclosure cooperating with the wrench heads, showing that the first handle body and the second handle body are rotated relative to each other to a desired angle.

When it is desired to adjust the relative angle between two wrench heads 12 and 14, both of the first handle body 30 and the second handle body 40 are pulled firstly to separate one of the positioning holes 35 of the first handle body 30 and the positioning pillar 45 of the second handle body 40, as shown in FIG. 4. At this moment, the restoring spring 50 is compressed by the rod head 24 of the fixation rod 20. Next, the first handle body 30 or second handle body 40 is rotated to the appropriate angle according to actual need so as to change the relative angle between the two wrench heads 12 and 14. Finally, the pulling force applied on the first handle body 30 is released to force another of the positioning holes 35 of the first handle body 30 to be sleeved onto the positioning pillar 45 of the second handle body 40 by the restoring force of the restoring spring 50, as shown in FIG. 5 and FIG. 6. Thereafter, the first handle body 30 and the second handle body 40 are engaged together and not allowable to rotate relative to each other again, so that the angle adjustment between two wrench heads 12 and 14 is completed, as shown in FIG. 7.

Figure 8:
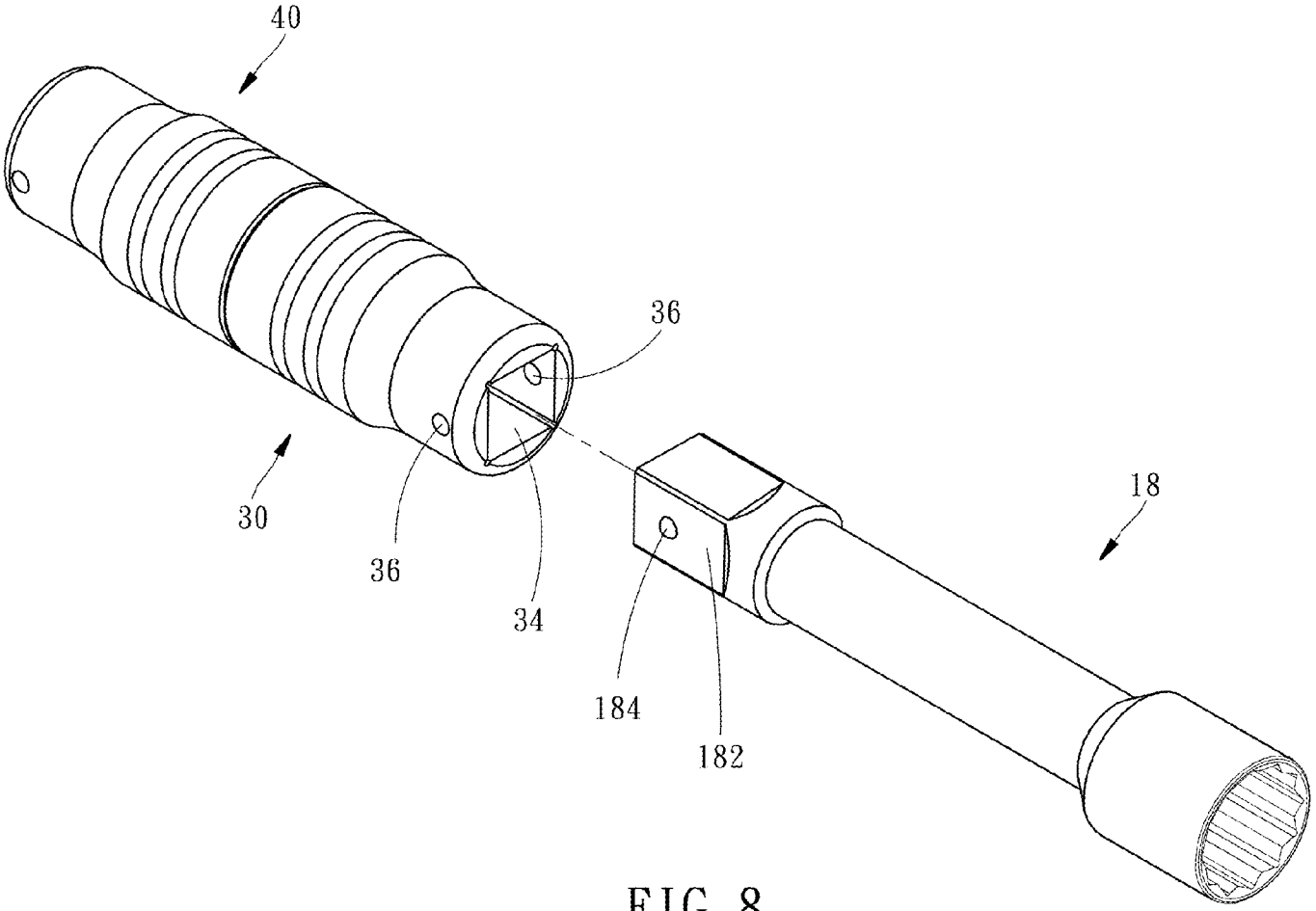
FIG. 8 is a schematic perspective view of the rotatable handle of the present disclosure in cooperation with a socket.

Except the wrench heads 12 and 14, the rotatable handle 10 of the present disclosure can also cooperate with a socket 18, as shown in FIG. 8. The process of mounting the socket 18 to the first handle body 30 is the same as the process of mounting another socket to the second handle body 40; therefore, only the process of mounting the socket 18 to the first handle body 30 is illustrated for saving space. During the mounting, the first rectangular fixation block 60 is taken out from the first rectangular fixation slot 34 of the first handle body 30, and a rectangular insert part 182 of the socket 18 is inserted into the first rectangular fixation slot 34 of the first handle body 30, and two steel balls 184 opposite disposed on the socket 18 are engaged inside the first radial hole 36 of the first handle body 30 to complete the installation of the socket 18. Therefore, the operation angle of the socket 18 can also be adjusted by the relative rotation between the first handle body 30 and the second handle body 40.

In summary, the rotatable handle 10 of the present disclosure can provide user to appropriately adjust the operation angle of the wrench head 12, 14 or the socket 18. After the angle adjustment is done, the user can operate the wrench directly without frequently changing the gripping angle during operation. Therefore, the objective of improving convenience in use can be achieved.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A rotatable handle for a wrench, comprising:

a fixation rod;

a first handle body having a first inner end surface, at least two positioning holes recessed inwardly from the first inner end surface, a first outer end surface opposite to the first inner end surface, and a first mounting slot located between the first inner end surface and the first outer end surface, the first handle body being rotatably and axially movably sleeved onto an end of the fixation rod via the first mounting slot; and a second handle body having a second inner end surface, at least one positioning pillar protruding outwardly from the second inner end surface, a second outer end surface opposite to the second inner end surface, and a second mounting slot located between the second inner end surface and the second outer end surface, the second handle body being rotatably and axially movably sleeved onto the other end of the fixation rod in such a way that each of the at least one positioning pillar is selectively inserted into one of the positioning holes.

2. The rotatable handle as defined in claim 1, wherein the first mounting slot stepwise extends from the first inner end surface toward the first outer end surface to form a stop surface, and the fixation rod has a rod head and a rod body connected with the rod head; a restoring spring is sleeved onto the rod body and abutted between the rod head of the fixation rod and the stop surface.

3. The rotatable handle as defined in claim 2, wherein the second mounting slot stepwise extends from the second inner end surface toward the second outer end surface.

4. The rotatable handle as defined in claim 3, further comprising a first rectangular fixation block and a second rectangular fixation block; wherein the first rectangular fixation block is fixed inside a first rectangular fixation slot that extends from the first outer end surface of the first handle body toward the first inner end surface of the first handle body and is communicated with the first mounting slot of the first handle body; the second rectangular fixation block is fixed inside a second rectangle fixation slot that extends from the second outer end surface of the second handle body toward the second inner end surface of the second handle body and is communicated with the second mounting slot of the second handle body.

5. The rotatable handle as defined in claim 1, wherein the first handle body comprises four said positioning holes arranged around the first mounting slot equiangularly.

6. The rotatable handle as defined in claim 1, wherein the second handle body comprises at least two said positioning pillars corresponding in number to the at least two positioning holes of the first handle body.

* * * * *